United States Patent [19]

Bergs

[11] 4,367,691

[45] Jan. 11, 1983

[54] APPARATUS FOR ADJUSTMENT OF THE COATING THICKNESS IN THE COATING OF TRAVELING WEBS

[75] Inventor: Erwin Bergs, Neuss, Fed. Rep. of Germany

[73] Assignee: Jagenberg Werke AG, Dusseldorf, Fed. Rep. of Germany

[21] Appl. No.: 274,324

[22] Filed: Jun. 15, 1981

[30] Foreign Application Priority Data

Jun. 19, 1980 [DE] Fed. Rep. of Germany ..... 3022955

[51] Int. Cl.³ ..... B05C 11/02

[52] U.S. Cl. ..... 118/119; 15/256.5

[58] Field of Search ..... 118/118, 119, 117, 110; 427/361; 15/256.5, 256.52

[56] References Cited

U.S. PATENT DOCUMENTS 3,817,208 6/1974 Barnschezdt et al. ..... 118/119

4,282,826 8/1981 Wohlfeil ..... 118/118

*Primary Examiner*—John P. McIntosh

*Attorney, Agent, or Firm*—Sprung, Horn, Kramer & Woods

[57] ABSTRACT

In an apparatus for coating a traveling web and comprising coating means for the web, a doctor roll which bears on the coated side of the web, a doctor-roll bed supporting the doctor roll and secured to the machine frame through a mount, and means for adjusting the location of the doctor roll and thus for adjusting the coating thickness, the improvement wherein the doctor-roll bed is made of an elastomeric material, and the adjusting means includes an inflatable tube between the doctor-roll bed and its mount constructed as a pressure chamber in the doctor-roll bed.

5 Claims, 1 Drawing Figure

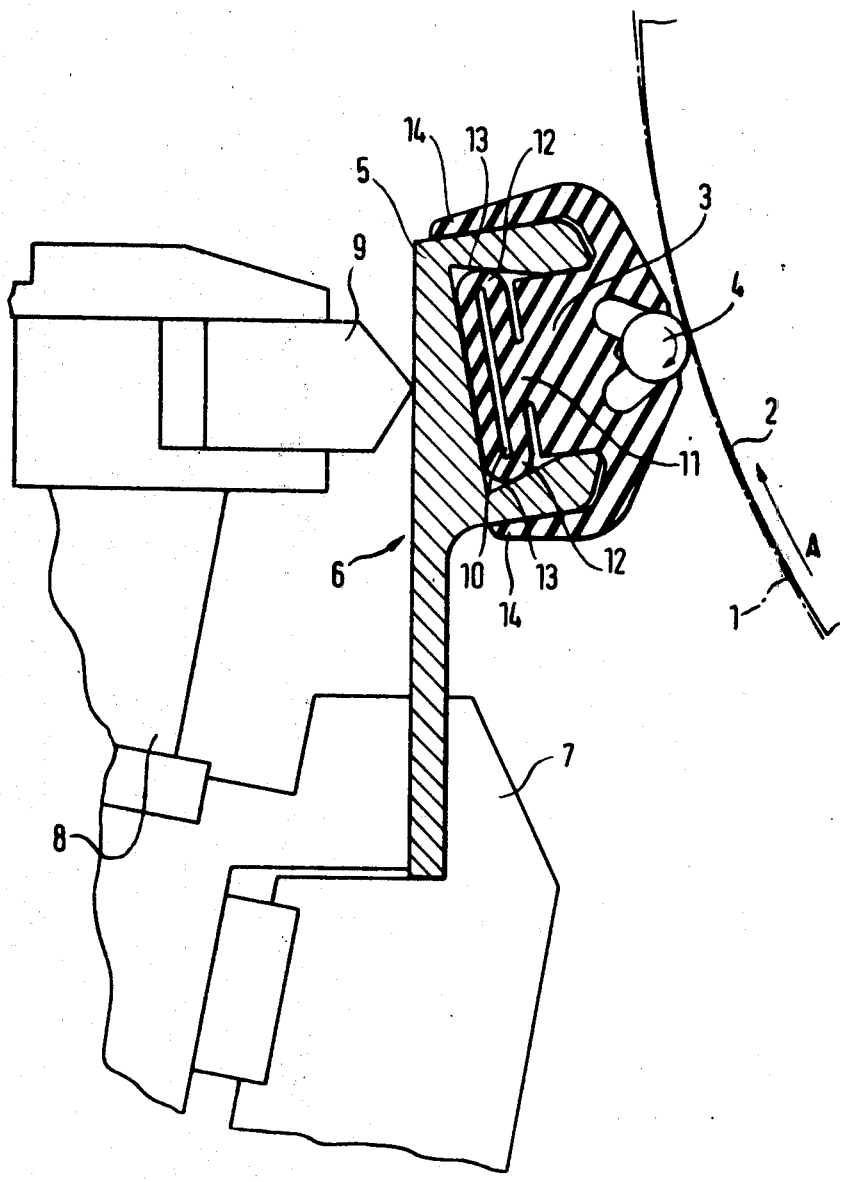
14
13
12
5
3
9
4
2
11
A
6
10
13
12
14
1
7
8

APPARATUS FOR ADJUSTMENT OF THE COATING THICKNESS IN THE COATING OF TRAVELING WEBS

BACKGROUND OF THE INVENTION

The invention relates to an apparatus for adjustment of the coating thickness in the coating of traveling webs by means of a doctor roll which bears on the coated side of the web and is supported in a doctor-roll bed that is secured to the machine frame through a mount, said apparatus comprising an inflatable tube between the doctor-roll bed and its mount.

An apparatus of this type is known from German patent application DOS No. 23 07 404, for example. The doctor-roll bed in that apparatus is made of a resilient material such as plastic or the like, and the tube which is inflated pneumatically is disposed as a separate part between the doctor-roll bed and the machine frame. Adjustment of the thickness in which the coating is applied, and hence metering of the coating material, are effected through variation of the pressure in the inflatable tube, the doctor roll being pressed against the web to be coated with greater or less pressure. The accuracy of adjustment is greatly affected by the ease with which the doctor-roll bed moves relative to its mount as the pressure in the inflatable tube is changed.

SUMMARY OF THE INVENTION

The object of the invention is to provide an apparatus of the type outlined above whereby sensitive and direct variation of the pressure with which the doctor roll bears on the web to be coated is secured as the pressure in the inflatable tube is changed.

In accordance with the invention, this object is accomplished in that the doctor-roll bed is made of an elastomeric material and that the inflatable tube is constructed as a pressure chamber in the doctor-roll bed.

A doctor-roll bed so constructed with an integral pressure chamber makes possible direct and inertia-free conversion of the pressure in the pressure chamber into bearing presure of the doctor roll on the web to be coated, immediate, inertia-free and unimpeded reduction of the bearing pressure of the doctor roll on the web to be coated occurring in particular when the pressure in the pressure chamber is reduced. No elastic opposing force is encountered as pressure medium, and preferably compressed air, is admitted to the pressure chamber since the rigid mount is not deformed. Stable operation at low pressure, and hence with high coating weights, is thus possible.

The pressure chamber is advantageously joined to the part of the doctor-roll bed which carries the doctor roll through a central fillet extending parallel to the doctor roll. This narrow fillet then permits positive conversion of the pressure in the pressure chamber into line-contact pressure of the doctor roll without any deformation of the pressure chamber being transmitted to the part of the doctor-roll bed which carries the doctor roll.

The elastomeric material of the doctor-roll bed preferably has a Shore hardness of about 80, which will assure on the one hand adequate flexibility of the pressure chamber, and hence said response of the bearing pressure to the pressure in the pressure chamber, and on the other hand the internal stability of the doctor-roll bed necessary to trouble-free guidance of the doctor roll.

The guideway in the mount which accommodates the doctor-roll bed is advantageously constructed so that, starting at the opening, it is at first parallel-walled and then expands in dovetail fashion toward the bottom. The parallel walls of the interior of the mount result in smooth-action guidance of the doctor-roll bed.

In proximity to the pressure chamber, the doctor-roll bed is advantageously provided with two bulges which project beyond the otherwise parallel sides of the doctor-roll bed and which when under pressure abut on the walls of the interior of the mount, enlarged in dovetail fashion. In this way, the doctor-roll bed is securely held or locked in the mount, which provides assurance that the doctor-roll bed will be retracted in the guideway of the mount when the system is unloaded, that is to say, when the pressure is reduced and the doctor roll is lifted off the backing roller.

Finally, the doctor-roll bed is advantageously disposed in a substantially U-shaped part of the mount and provided with two lateral lugs which externally reach around the legs of the U-shaped part. This feature of the invention offers the advantage of improved guidance of the doctor-roll bed relative to the mount and, in addition, the lateral lugs provide protection against fouling between the mount and the doctor-roll bed.

Through the design in accordance with the invention of the doctor-roll bed, sensitively responsive transmission of the pressure in the pressure chamber to the doctor roll is secured along with particularly simple construction and assembly of doctor-roll bed and mount. The doctor-roll bed can be inserted in the mount from the backing-roller side with the pressure chamber under superatmospheric pressure. The result is an easily maintained apparatus since the doctor-roll bed and the pressure chamber with which it is integral can readily and quickly be replaced as a unit when this becomes necessary.

An embodiment of the invention is illustrated in the accompanying drawing and will now be described in greater detail with reference thereto.

BRIEF DESCRIPTION OF THE DRAWING

Shown in the single FIGURE of the drawing is a side elevation of the doctor-roll bed in accordance with the invention and of the doctor roll in the associated mount, partly in section.

DETAILED DESCRIPTION OF THE INVENTION

In the apparatus illustrated in the drawing, a web 1 to be coated passes in the direction of the arrow A over a backing roller 2. A doctor roll 4 supported in a doctor-roll bed 3 is pressed with adjustable pressure against the web 1 and the backing roller 2. The doctor-roll bed 3 is seated in a substantially U-shaped part 5, which comprises in its lower portion a guideway expanded in dovetail fashion, of a mount 6 which by means of clamping bar 7 is secured to the machine frame 8 of the apparatus. In proximity to the doctor-roll bed 3, the mount 6 is linearly supported by an adjustable thrust bar 9.

The doctor-roll bed 3 is made of an elastomeric material having a Shore hardness of about 80 and on the side facing away from the doctor roll 4 is provided with a flat pressure chamber 10 of substantially constant wall thickness to which a pressure medium, and preferably air, is admitted. Through variation of the pressure in the pressure chamber 10, the bearing pressure of the doctor roll 4 on the web 1 to be coated and on the backing roller 2 is varied, and in this way sensitive and nearly inertia-free adjustment of the metering of the coating material, and hence of the thickness in which it is applied, is secured.

The pressure chamber 10 is joined through a central fillet 11 extending parallel to the doctor roll 4 to the part of the doctor-roll bed 3 which carries the doctor roll 4. Through said fillet 11, assurance is provided that variation of the pressure in the pressure chamber 10 immediately produces a change in the bearing pressure of the doctor roll 4.

In proximity to the flat pressure chamber 10, the doctor-roll bed 3 is provided with two bulges 12 which project beyond the otherwise parallel sides of the doctor-roll bed 3 and abut on the walls of the guideway, enlarged in dovetail fashion, of the mount 6. In this way, the doctor-roll bed 3 is securely held or locked in the mount 6.

The doctor-roll bed 3 is further provided with two lateral lugs 14 which externally reach around the legs of the U-shaped part of the mount 6. These lugs 14 improve the guidance of the doctor-roll bed 3 in the mount 6 and, in addition, provide protection against fouling between the doctor-roll bed 3 and the mount 6.

By making the doctor-roll bed 3 of an elastomeric material, and by forming the pressure chamber 10 in the doctor-roll bed 3 itself, provision is made for sensitive and rapid response of the doctor-roll bed 3 to the pressure in the pressure chamber 10 and also for simple, two-part construction of the mount 6 and the doctor-roll bed 3. The doctor-roll bed 3 with the doctor roll 4 can be readily and quickly removed from the mount 6 and reinserted therein; and the separate removal and insertion of the pressure tube can be dispensed with since the pressure chamber 10 is integral with the doctor-roll bed 3. Before the doctor-roll bed 3 is inserted in the mount 6, the pressure chamber 10 is placed under superatmospheric pressure, which causes the bulges 12 to recede behind the parallel sides of the doctor-roll bed 3. As the doctor-roll bed 3 is inserted from the side of the backing roller 2, the pressure is reduced. In removing the doctor-roll bed 3, the procedure is reversed. The doctor-roll bed in accordance with the invention thus makes a simple, readily assembled and easily maintained unit consisting of doctor-roll bed and associated mount.

It will be understood that the specification and examples are illustrative but not limitative of the present invention and that other embodiments within the spirit and scope of the invention will suggest themselves to those skilled in the art.

What is claimed is:

1. In an apparatus for coating a traveling web and comprising coating means for the web, a doctor roll which bears on the coated side of the web, an elastomeric doctor-roll bed supporting the doctor roll and secured to the machine frame through a mount, the doctor roll bed including an inflatable tube constructed as a pressure chamber, and means for adjusting the location of the doctor roll and thus for adjusting the coating thickness, the improvement wherein the pressure chamber is joined through a central fillet extending parallel to the doctor roll to that part of the doctor-roll bed which carries the doctor roll.

2. An apparatus according to claim 1, wherein the elastomeric material of the doctor-roll bed has a Shore hardness of about 80.

3. An apparatus according to claim 1, wherein the mount which accommodates the doctor-roll bed comprises a pair of walls defining a guideway, the walls being parallel at their beginning and then diverging so that the guideway expands in dovetail fashion.

4. An apparatus according to claim 3, wherein the doctor-roll bed in proximity to the pressure chamber is provided with two bulges projecting beyond the otherwise parallel walls of the doctor-roll bed.

5. An apparatus according to claim 1, wherein the mount is substantially U-shaped and the doctor-roll bed is seated therein, the bed including two lateral lugs which externally reach around the legs of the U-shaped portion of the mount.

* * * * *